United States Patent [19]

Langas

[11] Patent Number: 4,472,849

[45] Date of Patent: Sep. 25, 1984

[54] BEDSPRING ASSEMBLY WITH NOVEL BORDER WIRE AND METHOD OF FORMING THE LATTER

[75] Inventor: Arthur Langas, Glenview, Ill.

[73] Assignee: Hartco Company, Skokie, Ill.

[21] Appl. No.: 336,867

[22] Filed: Jan. 4, 1982

Related U.S. Application Data

[63] Continuation-in-part of Ser. No. 135,307, Mar. 31, 1980, abandoned.

[51] Int. Cl.[3] ..... A47C 23/04; A47C 23/053

[52] U.S. Cl. ..... 5/475; 5/260; 5/267; 140/3 CA

[58] Field of Search ..... 5/260, 259, 254, 267, 5/475; 140/3 CA; 72/199

[56] References Cited

U.S. PATENT DOCUMENTS

| | | | |
|---|---|---|---|
| 1,997,237 | 4/1935 | Schrier | 5/260 |
| 2,052,040 | 8/1936 | Sklar | 5/260 |
| 2,096,767 | 10/1937 | Sklar | 5/260 |
| 2,162,815 | 6/1939 | Krueger | 5/260 |
| 4,053,956 | 10/1977 | Higgins | 5/260 |
| 4,173,047 | 11/1979 | Schaefer | 5/260 |

*Primary Examiner*—Alexander Grosz

*Attorney, Agent, or Firm*—Balogh, Osann, Kramer, Dvorak, Genova & Traub

[57] ABSTRACT

An inner spring assembly embodying a generally channel-shaped border wire of the type which is provided with a continuous groove with straight sides and into which the end convolutions of the helical bedsprings of the assembly project in tangential fashion and about which the border wire is crimped to form a loose self-aligning non-rigid interconnection between springs and border wire. The border wire is formed from solid rod-like wire stock by a cold rolling operation in a shaping mill thereby obviating the necessity of resorting to machining and heat treating and eliminating waste material that is a consequence of machining. The rolling operation includes a reshaping of the solid cylindrical stock to a grooved border wire that offers a greater bending strength than like diameter solid border wire of the like weight per unit length.

6 Claims, 10 Drawing Figures

FIG. 1
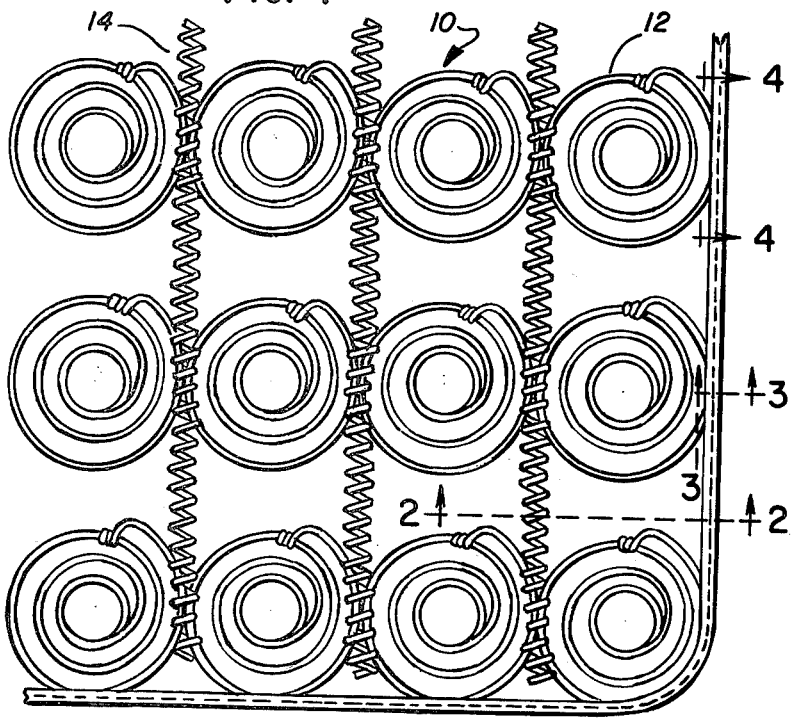
FIG. 2
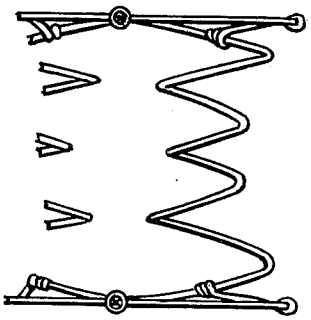
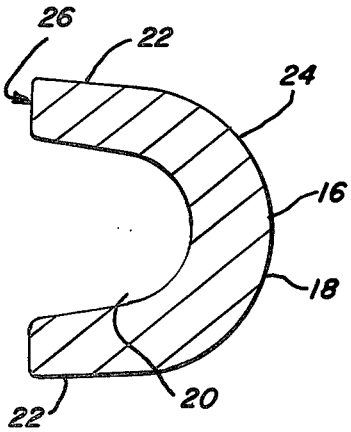
FIG. 3a
FIG. 3b
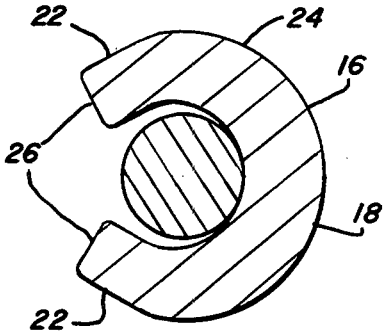
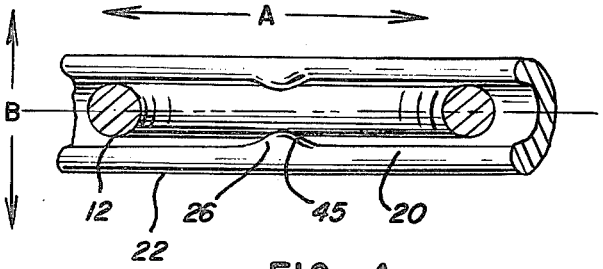
FIG. 4
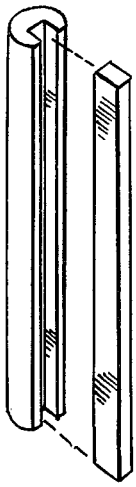
FIG. 5
PRIOR ART FIG. 6
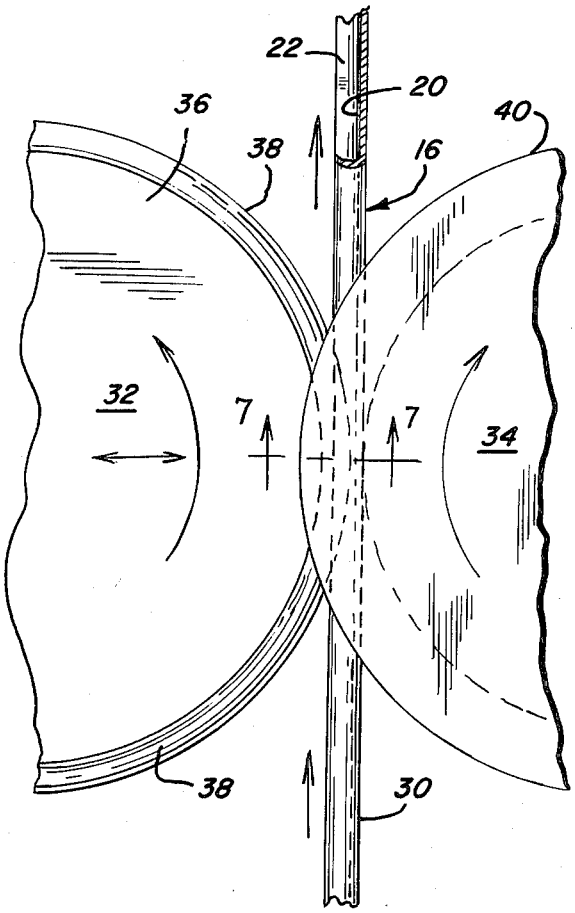
FIG. 7
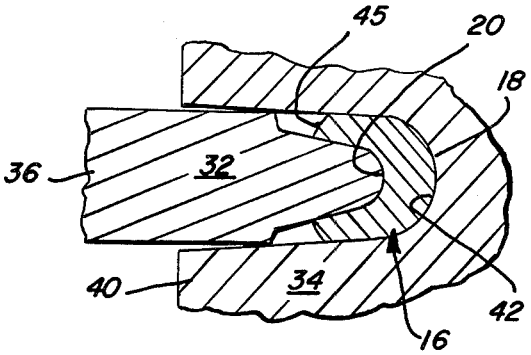
FIG. 8
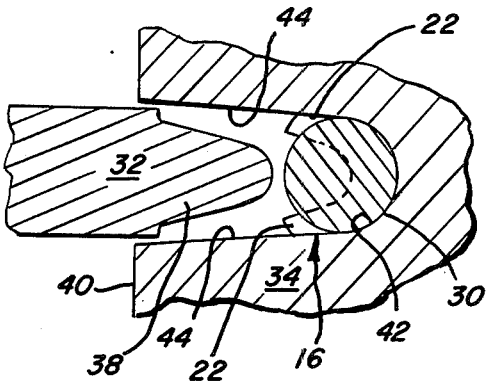
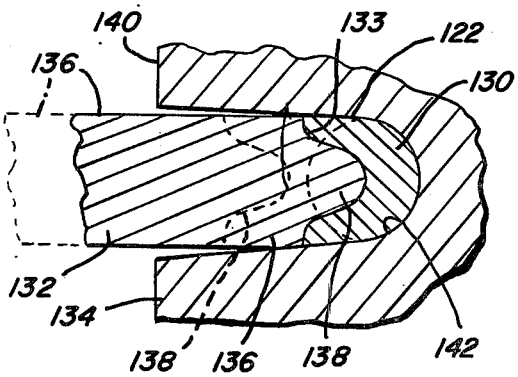
FIG. 9

BEDSPRING ASSEMBLY WITH NOVEL BORDER WIRE AND METHOD OF FORMING THE LATTER

This application is a continuation-in-part of U.S. Pat. Ser. No. 135,307, filed Mar. 31, 1980, now abandoned.

The present invention relates generally to an improved inner spring assembly and in particular to an improved border wire for use in connection with upholstered spring assemblies for furniture such as innerspring mattresses, cushions, spring seats and the like. The invention is, however, not limited to such use, and border wires embodying the principles of the invention may, if desired, be employed in connection with box spring constructions or the like. Irrespective, however, of the particular use to which the invention may be put, the essential features thereof remain substantially the same.

In the manufacture of innerspring assemblies (i.e., mattresses, upholstered furniture), it has long been the practice to employ cylindrical rod-like border wires or frames which lie in the planes of the upper and lower convolutions of the helix coils or bedsprings which are arranged in checkerboard fashion throughout the mattress, such border wires extending around the perimeter of the mattress and being anchored to the outside helix coils by continuous elongated small diameter helical binding wires which are commonly referred to as "helicals". These helicals are threaded around the cylindrical border wire so as to capture an end convolution of each helix coil or bedspring at its point of tangency with the border wire, thus holding the various helix coils or bedsprings in their proper relative positions. Such a method of joining a border wire to the adjacent helix coils is an expensive and laborious one commercially since it requires an experienced operator who must be trained for a period of at least six months.

In the interests of labor saving, there has been developed in the past, an elongated cylindrical border wire having a machined-out groove coextensive therewith and of a width substantially equal to the diameter of the stock from which the helix coils are formed. One end convolution of each bedspring is caused to enter the slot at the point of tangency and the walls of the slot are then deformed to maintain the end convolution of the bedspring in place. Such a border wire possesses the advantage of offering a smooth surface to any upholstery within which the innerspring assembly may be exposed, but the method involved in producing it is not economical because machining of the groove is a slow one and consequently it is expensive. Such method also tends to lock the end convolution in the slot, in a rigid and non-adjustable position. Furthermore, for proper machining of the groove, the border wire must be annealed before machining commences, and subsequently, it must be heat treated to prevent permanent distortion of the border wire under conditions of heavy loads. Finally, the machined-out groove represents an appreciable amount of wasted material that must be discarded.

Another method of producing a grooved border wire is by the use of drawing dies. This method also is slow and expensive due to the fact that the wire must be annealed after it is drawn through each die. Another problem arises in connection with collapsing of the groove during rewinding of the wire on the take-up reel. A major problem results because of the fact that the border wire must be pulled through the dies with great force. Since at least two passes through drawing dies are required, a commensurate number of annealing operations are necessary. Furthermore, the equipment required for such a method is extremely large and expensive.

The expense which is involved due to the need for skilled labor, the discarding of waste, the required annealing and heat treating, and the time which is expended in fashioning each unit length of a grooved border wire, is extremely large when it is considered that, in the United States alone, from fifteen to twenty million innerspring mattresses are produced and sold each year. It is common for a single manufacturer to produce one to one and a half million units in a single year and, for each penny saved in the manufacture of an innerspring mattress, there is an annual savings of approximately from $10,000.00 to $15,000.00.

The present invention is designed to overcome the above-noted limitations that are attendant upon the construction of innerspring mattresses and other upholstered furniture articles and, toward this end, the invention contemplates the provision of a slotted border wire which may be produced economically in a minimum period of time per unit length of wire, without any waste metal or other material and with production equipment that is not expensive, and also without requiring costly annealing and heat treating operations. In carrying out the invention, it is contemplated that the slotted border wire be produced from cylindrical wire or rod stock by a cold rolling operation in a shaping mill, utilizing a pair of cooperating roller dies including a female anvil roller and a male plunger roller, a single pass through such dies being sufficient to produce the desired channel-shaped border wire stock. Such border wire stock may thereafter be wound upon a take-up reel and subsequently fashioned into border wire or frame units for embodiment in an innerspring mattress construction, no annealing or heat treating operations being required at any stage of the process.

More specifically, the invention contemplates that the slotted border wire stock be fashioned in the shaping mill from conventional cylindrical solid wire or rod stock by a progressive swaging or metal deforming operation wherein the compressive forces exerted upon the wire or rod stock reshape it or rearrange the metal thereof, by a cold metal flow to a generally U-shaped cross-section with no loss or discard or waste of metal. The thus produced border wire stock is suitable for immediate fashioning into border wire units without requiring any annealing or heat treating operations.

In addition to the savings in cost due to the absence of waste metal, the saving in time, the elimination of molecular metal treating operations, and the fact that highly skilled labor is unnecessary, border wire stock constructed according to the present invention offers the functional advantage that, due to the cross-section of the completed slotted wire stock, a higher bending resistance over round cross-section border stock of the same diameter is attained. For border wires having the same weight per foot, border wires made by the present invention will withstand greater loads without becoming permanently deformed as compared to prior art border wires.

An important novel feature of the present invention that eliminates problems in the prior art resides in the rather loose and non-rigid connections between the spring coils and the slotted border wire. While the border wire firmly secures respective portions of each spring coil within its slot, such spring coil is movably and loosely or non-rigidly held within the border wire. This arrangement, which has not been disclosed or suggested in the prior art, increases greatly the resilience and flexibility of the inner spring assembly. This arrangement enables the border wire to compensate for and be unaffected by variations in alignment of the inner coil assembly.

As compared to the U-shaped spring assembly border wires known in the prior art, the present invention has numerous distinct advantages. The present invention involves a border wire whose groove is obtained by a rolling process rather than a machining process, which has the advantage of less cost and greater strength. The present invention uses straight outside walls of the U-portion of the cross-section, which enables roll-forming and permits loose crimping or folding of the ends of the outside walls over the coil, and which make the wire stiffer than other cross-sections. The loose connection of the spring in the border wire permits for compensation of variations in the spring assembly, which is not possible in the prior art constructions.

The provision of a novel border wire construction such as has briefly been outlined above, and possessing the stated advantages, together with a novel method by means of which it may be formed, constitute the principal object of the present invention. Numerous other objects and advantages, not at this time enumerated, will become readily apparent as the nature of the invention is better understood.

In the accompanying two sheets of drawings forming a part of this specification, two illustrative embodiments of the invention have been shown.

In these drawings:

FIG. 1 is a fragmentary top plan view showing one corner region of an innerspring mattress construction embodying the principles of the invention;

FIG. 2 is a sectional view taken on the line 2—2 of FIG. 1;

FIGS. 3*a* and 3*b* are enlarged fragmentary sectional views taken on the line 3—3 of FIG. 1;

FIG. 3*a* illustrates the border wire prior to engaging the spring coil;

FIG. 3*b* illustrates the border wire following the crimping operation and securing the coil spring therein;

FIG. 4 is an enlarged sectional view taken on the line 4—4 of FIG. 1;

FIG. 5 is a fragmentary side elevational view of a prior art method of transforming a cylindrical wire or rod stock into slotted border wire stock;

FIG. 6 is a sectional view illustrating the method by which the structure of the present invention is obtained, and it shows a pair of cooperating roller dies by means of which a length of solid cylindrical wire or rod stock is transformed by a cold rolling operation into slotted border wire stock.

FIG. 7 is an enlarged fragmentary sectional view, largely schematic in its representation, showing the roller dies proper in their metal working positions, the view being taken on the line 7—7 of FIG. 6;

FIG. 8 is a fragmentary sectional view, similar to FIG. 7, showing the roller dies in their inoperative positions of wire or rod stock release; and FIG. 9 is a fragmentary sectional view, similar to FIG. 7, showing a pair of cooperating roller dies for producing a slightly modified form of border wire stock.

Referring now to the drawings in detail, and in particular to FIGS. 1 and 3*a* and 3*b*, inclusive, a mattress innerspring assembly or construction is designated in its entirety by the reference numeral 10, and it involves in its general organization, the usual series of helical coil springs 12 which will hereinafter be referred to simply as bedsprings. In the illustrated environment of the invention, these bedsprings are a combination of spiral and helical coils that assume an hourglass shape when viewed from the side, but other spring configurations are contemplated. The bedsprings 12 are arranged in slightly spaced apart longitudinal rows, while the adjacent springs of each row exist in tangential relationship so that the transverse rows are contiguous. As is customary in the art, the upper and lower helix convolutions of the various bedsprings 12 are held together by means of elongated small diameter helicals 14 which are threaded through the tangential juncture regions of adjacent end convolutions so that they lie in the spaced apart upper and lower mattress surface planes, and hold the bedspring 12 together.

The upper and lower convolutions of the series of bedsprings, which lie in common horizontal planes, respectively, are each encompassed by one of the novel border wires 16 of the present invention. Such border wire is preferably cut from a roll of border wire stock (not shown) and fashioned to provide a horizontally disposed and completely rectangular frame-like structure, as is common in the art.

Shown in FIGS. 3*a* and 3*b*, the border wire 16 is generally of U-shape in transverse cross-section, and it is provided with an outside semi-cylindrical or rounded surface 18 and a coextensive inside groove 20 which establishes a pair of opposed and inclined side walls 22 and a bottom wall 24. The depth of the groove 20 and the distance between the side walls 22 are such that the groove will accommodate reception therein in tangential fashion of an adjacent portion of the associated end convolution of a bedspring 12 with a fairly loose and movable fit. At appropriate points along the border wires 16, the crimping of side walls 22 about the spring wires 12 (See FIG. 3*b*), forms pairs of oppositely disposed spaced-apart edges 26 which loosely and movably fit around the spring wires 12, so as to movably hold the bedsprings securely in position. The edges 26 have a curved configuration complementing that of the spring wires so as to closely yet loosely fit around the wire (See particularly FIG. 3).

As a result of this construction, the crimped edges 26 of side walls 22, secure the spring wires 12 in the groove 20, in a firmly held yet loose and non-rigid position. This allows the springs 12 to be movable relative to the border frame.

FIG. 4 illustrates in greater detail the movable fit construction described above. A portion of the end convolution of a spring 12 is shown loosely and movably secured in border wire 16. The spring 12 is firmly retained in border wire 16 by means of crimped edges 26 that are oppositely disposed (on the opposing side walls 22 of groove 20), spaced apart, and provided with curved arch-like configurations 45. Spring 12 can easily be rotated or moved through groove 20 of the border wire 16. For example, the end convolution of spring 12, as shown in FIG. 1, can be moved or rotated through the border wire, substantially with its entire circumference in the directions "A" (horizontal as shown in FIG. 4). The movement of any spring 12 in "A" directions is only limited by its respective position and linking connections to other springs 12 in the spring assembly. The end convolution 12 is also movable in an upward or downward direction relative to border wire 16 as shown at "B" in FIG. 4. However, this movement is far more restricted than the movement in the "A" directions.

The general arrangement of innerspring parts thus far described is purely conventional, such an arrangement being shown and described in U.S. Patent to Sklar, U.S. Pat. No. 2,096,767, granted on Oct. 26, 1937, and entitled "BEDSPRING", and no claim is made herein to any broad novelty associated therewith. The novelty of the present invention resides rather in the combination as a whole of the spring assembly including the novel features and the specific nature of border wire 16 which enables it to be produced practically by reason of certain discoveries and inventions relating to a process of cold rolling the border wire, and in the machinery used for that purpose, all of which will be more fully described in detail presently and subsequently claimed.

FIG. 5 illustrates a prior art method of forming a slotted border wire. The method transforms a conventional cylindrical wire or rod stock into a slotted border wire by machining out a groove coextensive therewith. Under such method, the dimensions of the developed border wire are the same as of the original wire or rod stock. In addition, the metal or material cut out or removed from the wire to form the slot is discarded as waste metal. The present invention, however, as shown in FIGS. 6–9, provides for production of a border wire integrally with a coextensive groove or slot without loss of metal. Furthermore, the developed slotted border wire has a large outside diameter as compared to that of an equivalent border stock of the same weight per unit length. As a result, it provides a high bending resistance at a much reduced cost of production.

As shown in FIG. 6, the border wire 16 is formed from a conventional cylindrical wire or rod stock 30 which is caused to pass between mating male and female roller dies 32 and 34, respectively, which may be provided in the working area of a suitable shaping mill. The roller die 32, as best shown in FIGS. 6 and 7, is a male or plunger die, and it is provided with a body portion 36 having a continuous peripheral plunger rib 38 thereon, while the roller die 34 is a female or anvil die having a body portion 40 which is provided with a continuous peripheral annular wire or rod-receiving seating recess 42 formed therein. The roller dies 32 and 34 are movable relatively toward and away from each other, the anvil die preferably having a fixed axis and the plunger die having a shiftable axis which is movable toward and away from the fixed axis.

The plunger die 32 is movable between the inoperative retracted position of wire or rod stock release in which it is shown in FIG. 6 and the fully advanced operative working position in which it is shown in FIG. 7. This latter working position remains a permanent or fixed position at all times during actual operation of the roller dies on the wire or rod stock, while the retracted position is assumed merely to release the wire or rod stock and the formed border wire stock when desired, as for example, in case of a jam. The male or plunger die is essentially a two-position roller die and means (not shown) are provided for maintaining it in either its operative metal-working position or its position of release. However, means (likewise not shown) are provided whereby the operative metal-working position of such roller die may be varied or adjusted to accommodate variable working conditions such as to compensate for wear or effect slightly different border wire stock contours or shapes.

Still referring to FIG. 6, and additionally to FIG. 7, when the plunger and anvil roller dies 32 and 34 are in their effective rod receiving and metal-working positions, the wire or rod stock 30 is fed endwise between the two dies as shown in FIG. 6, where it becomes progressively compressed or swaged by the rolling or pinching action of the dies which, of course, rotate in opposite directions. During this cold rolling operation, the metal of the wire or rod stock is compressed and thus caused to flow outwardly and in opposite directions around the plunger rib 38 thereby producing the bottom wall surface 24 (FIG. 3*a*) as well as the groove 20.

Still referring to FIG. 7, it is to be noted at this point that the plunger rib 38 is provided with slightly inclined or tapered walls which produce opposed similarly inclined walls in the groove 20 of the border wire stock in order to allow the plunger rib to release the shaped border wire stock which will progress forwardly in a linearly straight path and not tend to follow the circumferential movement of the plunger rib 38. Also, if it becomes necessary to shift the plunger die 32 to its inoperative position of release, there will be no tendency for the formed border wire to stick to the plunger rib. Still further, the use of a tapered plunger rib affords a sturdier construction that will resist breakage.

It is also to be noted that the side walls 44 of the seating recess 42 in the anvil die 34 present a slight inclination relative to each other, thus reducing the friction which is developed between the shaped border wire stock and the recessed side walls, and also facilitating removal of the slotted border wire stock and the cylindrical wire or rod stock from the shaping recess 42 when necessary.

Finally, it is to be noted that in the retracted inoperative position of the plunger die 32, as well as in any of the adjusted operative positions which it is capable of assuming, the peripheral region of the body portion 36 is straddled by the walls of the recess 42 in the anvil die 34 so that a steadying effect upon the plunger die is attained in order to maintain it at all times in a centered position with respect to the wire or rod stock undergoing deforming.

In FIG. 9, a different pair of cooperating roller dies 132 and 134 function to produce a slightly modified form of border wire or rod stock 116. Due to the similarity between the disclosures of FIGS. 7 and 9, and in order to avoid needless repetition of description, similar reference numerals but of a higher order have been applied to the corresponding parts as between these two similar views. In FIG. 9, the peripheral plunger rib 138 has a radial extent which is somewhat shorter than the radial extent of the plunger rib 38, while the anvil die 134 remains substantially unchanged. Due to the relatively small radial extent of the plunger rib 138, the amount of upward extrusion of the metal of the cylindrical wire or rod stock 130 which may take place is limited by the pair of downwardly facing annular shelf areas 133 on opposite sides of the plunger rib 138 regardless of the adjustment of the plunger die 132 relative to the anvil die 134. Due to the resistance to extrusion of metal during a cold rolling operation, the metal of the wire or rod stock 130 will not quite fill the space which exists between the body portion 136 of the plunger die 132 and the walls of the anvil recess 142, even when the plunger die is adjusted for maximum depth penetration into the recess. Therefore, due to the restrictive nature of the shelf areas 133, the character of the distal edges of the side walls 122 of the recess 142 will be varied according to the adjustment of the position of the plunger die 132 relative to the anvil die. In any event, the border wire stock which is produced by the roller dies 132 and 134 will have side walls 122 which are generally straight or planar (but not parallel) except for small diameter rounded outside edges.

In FIG. 9, the position of the plunger die 132 for border stock release is shown in dotted lines. The operation of the roller dies 132 and 134 is similar to that of the previously described roller dies so that further description is believed to be unnecessary.

The invention is not to be limited to the exact arrangement of parts shown in the drawings or described in this specification as various changes in the details of construction may be resorted to without departing from the spirit of the invention. For example, although it has been stated in connection with the shaping mill operation that relative movement between the plunger and anvil dies 32 and 34 is attained by maintaining a fixed axis for the anvil die and shifting the axis of the plunger die toward and away therefrom, it is obvious that the plunger die may be held stationary and the anvil die shifted toward and away therefrom to produce any adjustments that may be necessary. Additionally, although the two roller dies 32 and 34 have been described as being effective to reshape cylindrical wire or rod stock into channel-like grooved border wire stock, it is within the scope of the invention to employ roller dies which apply compressive force to the rod stock in such a manner as to progressively shift the metal from its original cylindrical configuration to a final channel-like configuration without waste (as in machining operations) of metal, regardless of diameter considerations or specific cross-sectional channel shapes that may be involved. The only requisite is that the border wire stock be provided with a groove having straight non-parallel side walls capable of straddling the end convolutions of the bedsprings and of being crimped thereafter. Therefore, only insofar as the invention has particularly been pointed out in the accompanying claims is the same to be limited.

Having thus described my invention, what I claim and desire to secure by Letters Patent is:

1. In an article of upholstered furniture, in combination, an assembly of helical coil springs arranged generally in checkerboard fashion with their axes extending vertically and in parallelism and having their uppermost convolutions lying in a common horizontal plane, a generally rectangular border frame disposed within said plane and encompassing said uppermost convolutions, said border frame comprising a metal border wire that is generally of U-shape in transverse cross-section, and is provided with a continuously inward opening groove having opposed side walls that are slightly inclined with respect to each other, and a curved bottom wall, said groove and said U-shaped cross-section being integrally formed with the border wire, without loss of material thereof, in a predetermined compressive-type process, the uppermost convolutions of the outside marginal springs of said assembly having limited portions projecting into said groove in tangential fashion, so as to movably fit therein between said side walls and said curved bottom, said side walls being provided with spaced-apart and curved crimped edges that fit around said projecting portions to movably secure the same in said groove.

2. In an article of furniture, the combination set forth in claim 1, wherein the border wire is roll formed from a rod stock.

3. In an article of furniture, the combination set forth in claim 1, wherein a portion of the length of the side walls of said U-shaped cross-section are substantially straight.

4. In an innerspring mattress construction, an assembly of helical coil springs arranged generally in checkerboard fashion with their central axes extending substantially vertically and in parallelism, said springs having their uppermost and lowermost end convolutions lying in respective upper and lower horizontal planes, and a generally rectangular border frame disposed within each of said planes and encompassing the associated spring convolutions, said border frame comprising a metal border wire that is generally of U-shape in transverse cross-section, and is provided with a continuously inwardly opening groove having opposed side walls that are slightly inclined with respect to each other, and a curved bottom wall, said border wire being integrally formed with said groove and said U-shaped cross-section in a predetermined compressive type process without loss of material thereof, each of the uppermost and lowermost convolutions of the outside marginal springs of said assembly having limited portions projecting respectively into said groove of the respective border frame, so as to movably fit therein between said side walls and said curved bottom wall, said side walls being provided with spaced-apart crimped edges that fit around said spring projecting portions to movably secure the same in said groove.

5. In an innerspring mattress construction, an assembly as set forth in claim 4, wherein said opposed side walls are substantially straight for a portion of their lengths.

6. In an innerspring mattress construction, an assembly as set forth in claim 4, wherein the inner and outer side walls of said U-shaped cross-section are substantially straight for at least a portion of side wall length.

* * * * *